United States Patent [19]

de Jager

[11] 4,294,430

[45] Oct. 13, 1981

[54] SUPPORTS

[76] Inventor: Christiaan L. de Jager, Flat 1, 322 Kingsway, Amanzimtoti, Natal Province, South Africa

[21] Appl. No.: 125,403

[22] Filed: Feb. 27, 1980

[51] Int. Cl.[3] ..... E04H 17/02

[52] U.S. Cl. ..... 256/58; 256/48; 256/53

[58] Field of Search ..... 256/48, DIG. 5, 52, 256/53, 49, 58

[56] References Cited

U.S. PATENT DOCUMENTS

| | | | |
|---|---|---|---|
| 223,665 | 1/1880 | Beecher | 256/DIG. 5 |
| 235,518 | 12/1880 | DeLany | 256/53 |
| 353,129 | 11/1886 | Gholson | 256/48 |
| 580,847 | 4/1897 | Clark | 256/53 |
| 785,259 | 3/1905 | Lieser | 256/52 |
| 1,188,958 | 6/1916 | Ludwick | 256/52 |

*Primary Examiner*—Andrew V. Kundrat

*Attorney, Agent, or Firm*—Sughrue, Mion, Zinn, Macpeak and Seas

[57] ABSTRACT

An elongate support having an integral flattened region or flange extending along its length and wherein spaced elongated apertures are formed in this flattened region of flange near its free edge to define frangible edge portions between the apertures and adjacent edge with these edge portions being frangible and deformable by manually operable tools to lock transverse wires in the openings resulting from fracture and bending of said edge regions.

3 Claims, 7 Drawing Figures

SUPPORTS

This invention relates to supports and, more particularly, to elongated supports of a type suitable for spacing, and optionally also supporting, a plurality of wires, ropes, cables or the like in spaced relationship.

Still more particularly, but not exclusively, the invention is concerned with supports of the type used in fencing areas of ground, and such supports are generally termed either standards, posts or poles in which form they actually support the fence or fencing droppers which serve simply to hold a plurality of transverse wires in fixed spaced relationship relative to each other.

When erecting a fence, the supporting posts, poles or standards are firstly located in the ground in their proper orientation and thereafter, depending on the type of fence, either plain wire or barbed wire strands are attached to the posts, poles or standards to extend transverse thereto and usually in parallel relationship to each other. The attachment of such strands of wire to the standards, posts or poles is effected generally by means of binding wire which is wrapped around the standard, post or pole to engage the strands of fencing wire and locate them in position relative to each other up the height of the standard, post or pole.

In some cases, where plain wire is used primarily as a support for a diamond mesh or other latticed wire, the supporting strands of wire are passed through spaced holes punched up the height of the standards, for example.

In either case an appreciable amount of labour and material is involved in properly attaching the strands of wire to the standards, poles or posts during the erection of a fence. Also, where a barbed fence is erected, there are generally included between supporting standards, posts or poles, a number of fencing droppers the function of which is primarily to maintain the correct spacing of the parallel wires relative to each other. The same method of attaching the wires to the fencing droppers is used i.e by means of binding wire.

In each case the binding wire must be cut from a roll thereof and wrapped around the fencing wire and the standard, post, pole or dropper, normally twice, and then the free ends must be twisted together and cut off. It will be understood that a substantial amount of labour is involved in such an operation and also the erection of fences is time consuming at least partly as a result of the use of such binding wire.

Many solutions to the above problem have been proposed, and in general, they involve various slot formations in a fencing support which either render transverse withdrawal of the wire located therein difficult after the wire has been tensioned, or have deformable lips which are peened over to hold a wire located therein.

Examples of such arrangements are to be found in the specifications of U.S. Pat. Nos. 312,524; 200,153; 380,627; 429,038; 462,500; 619,030; 1,280,355; 1,352,203; and 10,362 and British Pat. No. 4536.

One of the difficulties involved with the creation of special formations such as slots in a fencing support, is that it is desirable to have the slots formed by a rolling process. It has been found in practice that punching holes or slots in a rolling operation can result in machinery downtime since the punched out pieces of metal may find their way into the production apparatus and thereby cause blockages and other damage. Further, any secondary or subsequent operation in the production of an article inevitably increases production costs substantially.

Another difficulty is that open mouthed slots or recesses are difficult to form in a rolling process where a deformable lip is to be formed simultaneously.

In this specification it is to be understood that the term "standard" as used hereinafter is intended to embrace within its scope both poles and posts which may be used for supporting strands of fencing wires whilst the term "dropper" will be used to mean an elongate member used primarily for maintaining wires in fixed spaced relationship relative to each other as opposed to supporting them.

It is one object of this invention to provide a support which can be made without the formation of open mouths having deformable lips but nevertheless, by using a rolling operation.

It is another object of this invention to provide a support of the general type referred to above which can be produced by a metal rolling process in a production line but without the formation of separate punched out pieces.

In accordance with this invention there is provided an elongate support having a number of apertures therethrough spaced apart along its length, each aperture having a frangible edge portion of the support between the aperture and edge of the support and wherein such edge portion is frangible and deformable by manually operable tools.

Further features of the invention provide for the opening to be a rectangular slot formed parallel to the length of the support in a metal rolling mill production line; for the slots to be formed by cutting the longitudinal sides thereof, deformably pressing the strip of metal between the two sides transversely outwards from the slot so that the strip remains attached to the support at its ends followed by deforming the strip away from the frangible edge portion of the support; for the said operations to be performed during a rolling process by suitable rolling tools; and for the support to have a cross-sectional shape providing a flange or like flat portion which has the apertures formed therethrough.

It is a particular feature of the invention that the said edge portion of the support is frangible using simple lever based manual operable tools such as pliers, side cutters, or the like.

The support may be either a fencing standard or a fencing dropper, and is of cross-sectional shape, which can be formed by a metal rolling process.

The invention also provides a method of attaching a strand of fencing wire to a support as above defined comprising the fracturing of an edge portion of the support between an aperture and the edge of the support, bending the said edge portion to allow for insertion of a transverse fence wire in the resultant opening and thereafter deforming said edge portion to lock the fence wire in the opening.

Further features of this aspect of the invention provide for the edge portion of the support to be fractured by lever operated manual tools such as a pair of pliers or side cutters, for example, and for the edge portion to be fractured roughly centrally along the length of an aperture defined thereby.

The invention also provides a fence whenever erected using a method as defined above.

In order that the invention may be more fully understood, embodiments thereof are further described with reference to the accompanying drawings in which.

Figure 1:
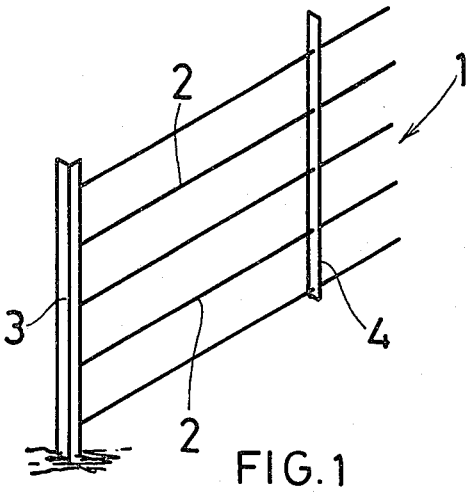
FIG. 1 illustrates a portion of a fence having a standard and a dropper therein.

As illustrated in FIG. 1, a portion of a fence 1 comprises a number of parallel strands of barbed wire 2 which are supported on standards 3 spaced apart by a suitable distance and wherein the strands are maintained in spaced relationship relative to each other by droppers 4 interposed between adjacent standards.

The invention is further described in use with respect to a dropper, but can equally well be used on a standard having suitable flanges.

Figure 2:
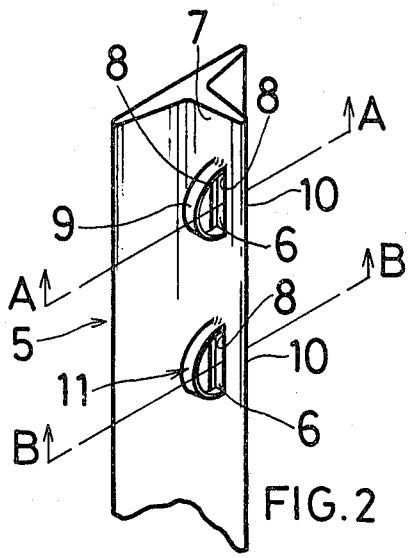
FIG. 2 is an oblique view of a dropper having openings therein according to the invention.
Figure 3:
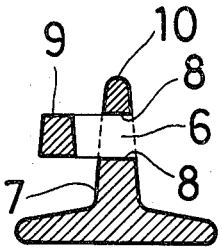
FIGS. 3 & 4 are cross-sectional views taken along lines A—A and B—B in FIG. 2 and illustrating the two stages in the formation for opening during a rolling process.
Figure 4:
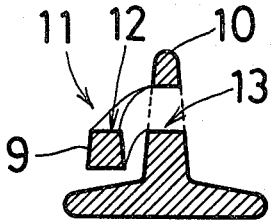

Referring now to FIGS. 2, 3 and 4, a dropper 5 has elongated apertures 6 therein spaced along the length of a flange formation 7 thereof. A common Tee-shaped cross-sectional dropper shape is illustrated, but clearly other suitable cross-sectional shapes may be substituted. It is common to all such shapes that a flat formation be provided for the apertures.

The apertures 6 take the form of elongate rectangular slots which are preferably formed during a rolling process in which the droppers are manufactured and at least in a steel rolling production line.

In order to avoid the presence of punched out pieces of material which can cause damage to the production machinery, the slot is punched out so that the unwanted material is not completely removed from the dropper.

The rectangular apertures 6 have their longitudinal axis parallel to that of the dropper, and the sides 8 of the apertures are cleanly severed from the punched out material. However, the width of the apertures are still connected to this material at each end of the apertures which then forms a stip 9 extending in an arc from the flange between the ends of the aperture. This is shown clearly in FIGS. 2 to 5 of the drawings.

The apertures are located sufficiently close to the edge of the flange 7 so that the edge portion 10 of the dropper between the aperture and the edge of the dropper is frangible, for example by the application of force with a pair of pliers or side cutters. The dropper itself is of a metal wich is sufficiently malleable to allow the edge portion 10 to be fractured either at one end or preferably centrally and bent away from the opening somewhat without becoming detached from the dropper.

The arched strip 9 is then peened down during a subsequent stage of the rolling process in a direction at right angles to the length of the apertures and away from the edge portion 10. This portion of the strip is indicated by numeral 11 in FIG. 4.

The effect of this is that the opening is substantially clear of obstructing material in a direction transverse to the plane thereof, and this makes it possible for wire fencing strands to be located, in use, in the apertures or resultant openings in that direction. Also, it is preferred that the outer edge 12 of the strip 9 of material be coplanar with the inner edge 13 of the aperture in each case as shown clearly in FIG. 4.

Figure 5:
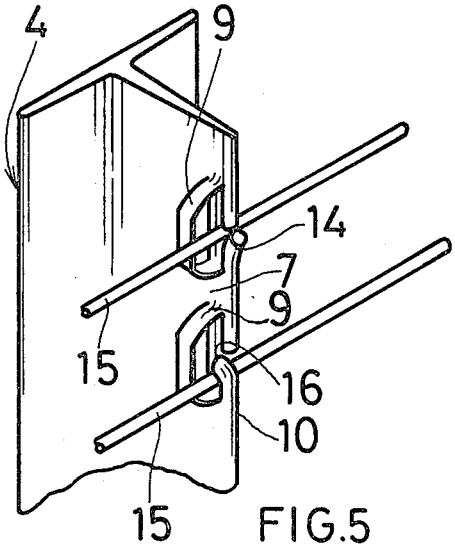
FIG. 5 is an oblique view of part of a dropper with fencing wires located in openings therein; and, FIGS. 6 & 7 illustrate, a perspective view, short sections of alternative shapes of standards or droppers.

In use, the edge portion 10 may be fractured as above described, at or near an end thereof, or preferably centrally along its length, and bent away from the resultant opening as indicated by numeral 14 in FIG. 5. This may conveniently be done with a pair of pliers during the erection of a fence.

A strand of fencing wire 15 may then be located transversely in such an opening through the gap between the fractured ends of the edge portion 10 of the dropper. Once thus located, the strand is secured in position by bending the appropriate edge portion over the strand and towards the rear of the opening, as indicated by numeral 16 in FIG. 5. This may also be done by means of a pair of pliers. The advantage of cutting the edge portion 10 centrally along its length is that a second portion can be used to secure a fence wire to the dropper should a first one break.

The strand is thus secured in its aperture or opening against withdrawal in a direction transverse to the length thereof. clearly, strands so located will be positioned in apertures or openings along the dropper length which provide a desired spacing between successive parallel strands.

It is considered that the invention provides an easy means for securing wire fencing strands to a dropper or standard and that the manufacture of such fencing supports can be effected easily and involves relatively little extra cost compared to ordinary supports.

Many variations may be made of the above described embodiment of the invention without departing from the scope hereof. For example, while it is preferred, for reasons stated above, to use apertures which are not completely punched out, they may be provided by any suitable means, the essential element being that a frangible edge portion thereto is available for the insertion of a strand after fracture as described. The opening may be of any suitable shape and the invention may be provided on a tubular support as long as a frangible edge portion is provided.

Figure 6:
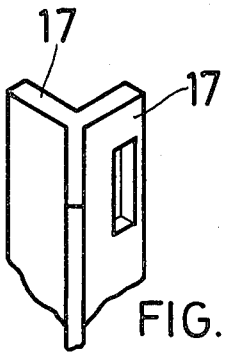
Figure 7:
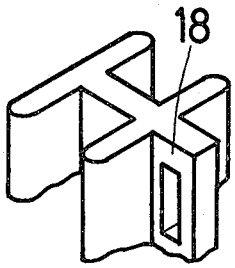

As mentioned above the cross-sectional shape of the dropper or standard can be varied widely. Simply by way of example FIG. 6 illustrates a common form at equal angular positions and wherein any flange may have the apertures as provided by this invention. FIG. 7 shows a conventional I-sectioned standard having an additional flange 18 formed in the manufacturing process and which can be provided with apertures as required by this invention.

What I claim as new and desire to secure by Letters Patent is:

1. A fence wire support, comprising:

(a) an elongated, substantially planar strap (7) of malleable metal, (b) a plurality of closed, elongated slots (6) defined in the strap at spaced locations along its length, (c) each slot lying just inwardly of one edge of the strap and oriented substantially parallel thereto to define an integral continuous strip (10) of the support between an outer side (8) of the slot and said one edge of the strap, said strip being frangible and deformable by manually operable tools pursuant to the installation of a fence wire in the slot; and a web of metal (9,11) displaced during the formation of each slot spanning and connected between the opposite ends thereof, each web (11) being bent away from said one edge of the strap to leave its associated slot substantially laterally unobstructed.

2. A support as claimed in claim 1 in which the strap comprises a flange extending along the length and defining part of the support.

3. A support as claimed in claim 1 in which the slots are rectangular.

* * * * *